United States Patent [19]

Ehrlich

[11] 3,998,004

[45] Dec. 21, 1976

[54] GEOMETRIC CONSTRUCTION KIT

[76] Inventor: Brent H. Ehrlich, R.R. 1, Murphysboro, Ill. 62966

[22] Filed: May 27, 1975

[21] Appl. No.: 580,981

[52] U.S. Cl. ..... 46/30; 46/236; 46/241

[51] Int. Cl.[2] ..... A63H 33/10; A63H 33/26

[58] Field of Search ..... 46/23, 25, 30, 236, 46/239, 241

[56] References Cited

UNITED STATES PATENTS

| | | | |
|---|---|---|---|
| 1,236,234 | 8/1917 | Troje | 46/23 |
| 2,776,521 | 1/1957 | Zimmerman | 46/30 |
| 2,872,754 | 2/1959 | Cronberger | 46/241 |
| 3,196,579 | 7/1965 | Lepper | 46/241 |
| 3,426,453 | 2/1969 | Dingwall et al. | 46/239 |

*Primary Examiner*—G.E. McNeill
*Assistant Examiner*—Robert F. Cutting
*Attorney, Agent, or Firm*—Johnston, Keil, Thompson & Shurtleff

[57] ABSTRACT

This invention employs a multiplicity of polygon-shaped members having magnetic edges which permit the members to be easily joined in order to fabricate two- and three-dimensional objects such as polygons and polyhedra for recreational and/or educational use.

11 Claims, 10 Drawing Figures

GEOMETRIC CONSTRUCTION KIT

BACKGROUND OF THE INVENTION

Existing methods used in fabricating geometric objects from planar polygon-shaped members are not adapted for use by young children. Furthermore, while the known apparatus can be used for classroom instruction with moderate success, a construction kit having more versatility and ease in use is needed.

Known systems employ in addition to the planar polygon-shaped members separate means for connecting the edges of the members. For example, in U.S. Pat. No. 2,057,942 each edge of each of the polygon-shaped members is provided with matable hinge knuckles. A pin must be inserted through a mated set of knuckles to securely fasten the member edges to each other. U.S. Pat. No. 3,614,835 discloses an educational toy construction kit which also has separate fastening devices to attach the edges of the members. Once fastened, however, little if any relative movement between two members is possible. In addition, some of the several fastening means disclosed in the patent require as many as six individual elements to fasten one edge of one member to one edge of another member.

Not only do the separate fastening members of the above devices require precise positioning of the various individual parts to permit assembly, but they require the handling and manipulation of many more parts than just the fundamental polygon-shaped members. Especially for young children, both of these factors generate problems. Often the children have neither the physical coordination nor the patience required to assemble the pieces. In addition, the small fastening members are easily lost. Although these considerations are not as important when the construction kits are used by older children and instructors for geometric analysis, a simpler means of fastening the polygon-shaped members would nevertheless be a significant improvement.

OBJECTS AND SUMMARY OF THE INVENTION

An object of the present invention is to provide a geometric construction kit which may be assembled and disassembled with greater ease than is possible with known devices.

A further object is to eliminate the need for separate fastening means thereby reducing the components of the construction kit to only the polygon-shaped members themselves.

According to the invention, rod, bar, or flexible strip magnets are fastened to or embedded in the edges of polygon-shaped members which are to be used as faces of geometric objects. The polygon-shaped members may have solid surfaces or may have openings in the central portion. The magnets are arranged such that at each vertex are at least one north pole and one south pole of a magnet. This arrangement orients the magnets in a north-to-south relationship around the circumference of the polygon-shaped member. Thus, when viewed from one side of the member, the north-to-south relationship of the magnet ends proceeds clockwise around the circumference, while when viewed from the other side, the north-to-south relationship proceeds counterclockwise around the circumference of the member. By identifying the respective clockwise and counterclockwise sides of the members and keeping the members similarly oriented, the edges of the members will be attracted. The result of the attraction is that when an edge of one member contacts an edge of another member, the members are flexibly held together. The magnitude of the attractive forces must be such that when three or more members are mutually connected in a non co-planar arrangement, the resulting three-dimensional structure is rigid enough to maintain its integrity with little or no supplemental support.

Given the magnetic arrangement outlined above virtually any three-dimensional object having polygon-shaped faces can be quickly and easily constructed. For example, four equilateral triangles can be joined to form a regular tetrahedron; or six squares can be joined to form a cube.

Disassembly is also quick and easy. To separate the edge of the members they need only be pulled apart with a force sufficient to overcome the magnetic attraction. The advantages to the construction kit outlined above are apparent. Not only are a minimum number of pieces involved but also the magnets greatly simplify the fabrication and disassembly of the geometric objects.

DRAWINGS

DETAILED DESCRIPTION OF THE INVENTION

Figure 1:
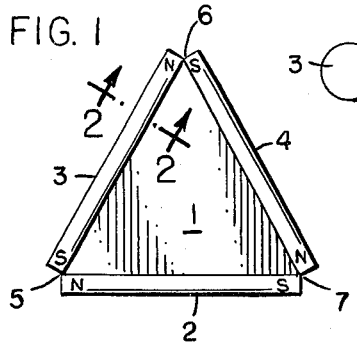
FIG. 1 shows an embodiment of a triangular member according to the invention.
Figure 2:
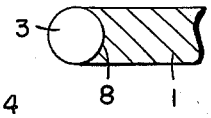
FIG. 2 is a cross section of FIG. 1 taken at line 2—2.

FIG. 1 shows a preferred embodiment of a polygon-shaped member equipped with magnets along the edges. Member 1 may be made of any suitable non-magnetic material such as wood or plastic. Rod magnets 2, 3 and 4 are attached to the edges of triangular member 1. The means of attachment can be a suitable adhesive along arcuate surface 8 shown in FIG. 2. The magnets are arranged so that at each of the vertices 5, 6 and 7 there is one north (N) pole and one south (S) pole. Thus, at vertex 5 are the north pole of magnet 2 and the south pole of magnet 3; at vertex 6 are the north pole of magnet 3 and the south pole of magnet 4; and at vertex 7 are the north pole of magnet 4 and the south pole of magnet 2. As explained and illustrated later, this orientation of the magnets--N-S-N-S-N-S going clockwise around member 1—assures that there will be an attraction between any of the member's edges and any edges of another member with edge magnets having the same clockwise N-S-N-S...orientation.

Figure 3:
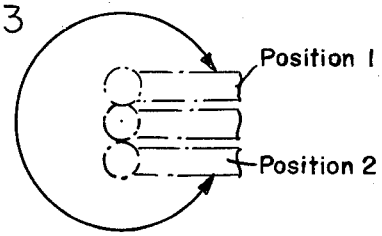
FIG. 3 illustrates the freedom of movement between two members.

FIG. 3 illustrates that by using rod magnets and selecting their diameters equal to or slightly greater than the thickness of the member, the result is minimum inter-member flexibility. Any of the infinite positions between and including Positions 1 and 2 are achievable.

Figure 4:
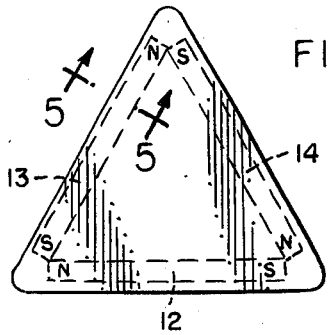
FIG. 4 shows an alternative embodiment of a triangular member.
Figure 5:
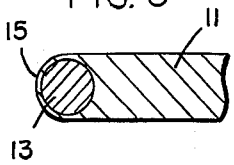
FIG. 5 is a cross-section of FIG. 4 taken at line 5—5.

FIGS. 4 and 5 illustrate an alternative embodiment of the invention particularly advantageous when the polygon-shaped member is to be injection molded. The magnets 12, 13 and 14 may be embedded in the edges of the member 11. By leaving only a thin layer 15 of the molded material, the edges of members will be attracted as in the first embodiment. This alternative configuration, however, eliminates the need for an adhesive bond between the magnets and the member. In addition, the layer of molded material provides a moisture-proof barrier to deter the rusting of the magnets.

Figure 6:
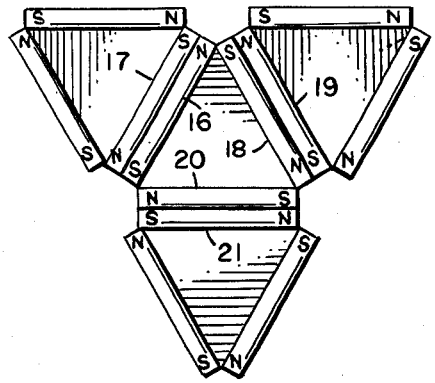
FIG. 6 shows a two-dimensional arrangement of four triangular members.

FIG. 6 shows a two-dimensional arrangement formed from four triangular-shaped members according to the embodiment shown in FIG. 1. Attraction between magnets 16 and 17, between magnets 18 and 19, and between magnets 20 and 21 occurs because each of the four members have the clockwise N-S-N-S-N-S magnet orientation explained above. Attraction of the magnets would similarly occur if all had a counterclockwise N-S-N-S-N-S magnet orientation. A mixture of clockwise and counter-clockwise orientations, however, would result in repulsion of some or all of the members' edges.

Figure 7:
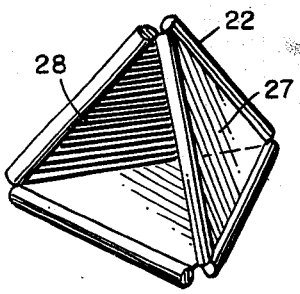
FIG. 7 shows a tetrahedron constructed from four triangular members.

The three "corners" of the two-dimensional arrangement in FIG. 6 can be "folded up" to form the tetrahedron shown in FIG. 7. It is significant to note that there will be attraction between all six pairs of edges since, as viewed from either the inside or the outside of the three-dimensional figure, all members have the same clockwise or counter-clockwise N-S-N-S-N-S magnet arrangement. The mutual attraction of all pairs of edges will always occur given the uniform magnet arrangement regardless of the number or shape of the members.

Triangular-shaped members are shown for illustrative purposes in FIGS. 1, 4, 6 and 7, but it should be recognized that the polygon-shaped members may be made in any of the innumerable shapes and sizes of regular or irregular polygons. Except in specialized applications it is expected that the most common regular polygons, i.e., triangles, squares, pentagons and hexagons, will be included in the construction kits. By making the edges of the various members of equal lengths, or of integral multiples of each other, the mixture of the various shapes in a single two- or three-dimensional object will be facilitated.

Figure 8:
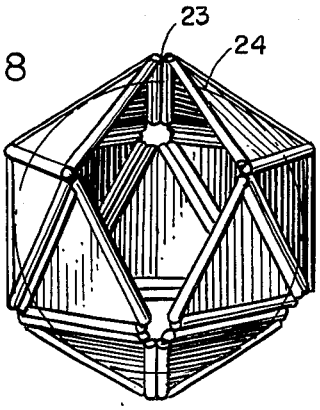
FIG. 8 shows a portion of an icosahedron fabricated around a sphere.

As the number of faces in three-dimensional objects constructed from the kit is increased, the ability of the structure to maintain its integrity depends upon several factors, including the weight of the members and the strength of the magnets. Spheres or bowls, the sizes of which may be readily calculated using known geometric and trigonometric relationships, may be utilized to provide the additional structural support necessary to fabricate objects larger than the physical characteristics of the members would otherwise permit. For example, FIG. 8 shows a portion of a 20 sided object 23 made up of equilateral triangles, the fabrication of which is aided by the presence of a sphere 24 the diameter of which equals the maximum which could be inscribed in the completed icosahedron.

Figure 9:
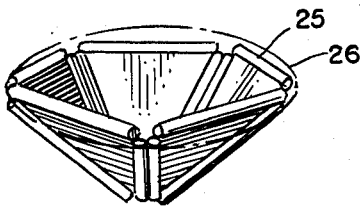
FIG. 9 shows a portion of a semi-icosahedron fabricated in a bowl.

Similarly, FIG. 9 shows a portion of a semi-icosahedron 25 fabricated with the aid of a bowl-shaped support 26 the inside diameter of which equals the minimum which could be circumscribed around the completed semi-icosahedron.

The large central surfaces of each member may be solid, as shown for example in FIG. 7 at 27. In the alternative, these central portions may be cut out as shown in FIG. 7 at 28 in order to reduce the weight of each member and to permit inspection of the interior of a completed three-dimensional object.

Figure 10:
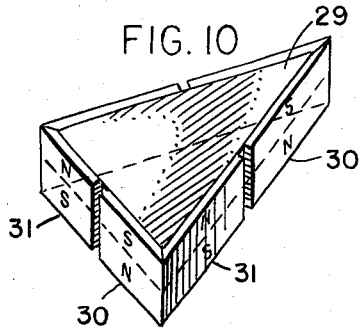
FIG. 10 shows an alternative embodiment of a triangular member.

Strips of flexible magnetic material may be substituted for the rod or bar magnets shown in FIGS. 1–9. Such magnetic strips commonly have the polarity divided along their longitudinal axes. By arranging two strips on each edge of a member with their polarities reversed as shown in FIG. 10, like members would attract in a manner similar to that in which like members having bar or rod magnets will attract. Member 29 has magnets 30, 31 suitably fastened to its edges so that the polarities alternate at each corner.

The description in detail may suggest various changes and other departures within the spirit and scope of the appended claims.

I claim:

1. A construction kit comprising a plurality of substantially planar members having edges, the perimeters of said members as constituted by said edges forming polygons, each of said members having a magnet longitudinally arranged along each of the edges thereof, said magnets being oriented such that at each vertex of said polygon-shaped member the polarities of the adjacent magnets are opposite, said arrangement resulting in an attraction between the edge magnets of members having the same magnet arrangement, whereby two-and three-dimensional objects can be fabricated from a multiplicity of said members held together by the attractive forces between the magnets of adjacent members.

2. A construction kit as set forth in claim 1 wherein the lengths of the edges of each of said members are multiples of each other and of the edges of the other members.

3. A construction kit as set forth in claim 1 wherein at least some of the members have the shape of regular polygons.

4. A construction kit as set forth in claim 3 wherein at least some of the members have edges of equal lengths.

5. A construction kit as set forth in claim 4 wherein at least two of the members have congruent shapes.

6. A construction kit as set forth in claim 1 wherein said magnets are rod magnets.

7. A construction kit as set forth in claim 6 wherein the diameter of said rod magnets equals or exceeds the thickness of said members.

8. A construction kit as set forth in claim 1 wherein the faces of the polygon-shaped members are marked to identify the magnet orientation.

9. A construction kit as set forth in claim 1 which further comprises spheres and bowls, the sizes of which are chosen to facilitate the fabrication of three-dimensional objects from said members by offering internal and external supplemental support, respectively.

10. A construction kit comprising a plurality of substantially planar members having edges, the perimeters of said members as constituted by said edges forming polygons, each of said members having a rod magnet embedded longitudinally along each of the edges thereof, said magnets being oriented such that at each vertex of said polygon-shaped member the polarities of the adjacent magnets are opposite, said arrangement resulting in an attraction between the edges of members having the same magnet arrangement, whereby two- and three-dimensional objects can be fabricated from a multiplicity of said members held together by the attractive forces between the magnets of adjacent members.

11. A construction kit as set forth in claim 10 wherein said members are molded around said magnets.

* * * * *